United States Patent [19]

Carlisle

[11] 4,171,755

[45] Oct. 23, 1979

[54] FLEXIBLE CONTAINER WITH POURING SPOUT

[76] Inventor: Richard S. Carlisle, P.O. Box 307, Rye, N.Y. 10580

[21] Appl. No.: 814,979

[22] Filed: Jul. 12, 1977

[51] Int. Cl.[2] ..... B65D 37/00

[52] U.S. Cl. ..... 222/107; 150/9; 206/390

[58] Field of Search ..... 222/491, 494, 107; 206/390; 150/9; 229/53, 62, 62.5, 69

[56] References Cited

U.S. PATENT DOCUMENTS

| | | | |
|---|---|---|---|
| 3,009,498 | 11/1961 | Fohr | 222/107 X |
| 3,416,528 | 12/1968 | Kahn | 222/83 X |
| 3,453,797 | 7/1969 | Soto | 53/14 |
| 3,587,844 | 6/1971 | Wing | 229/69 X |
| 3,815,794 | 6/1974 | Carlisle | 222/491 |
| 3,935,993 | 2/1976 | Doyen et al. | 229/53 |

*Primary Examiner*—Robert J. Spar
*Assistant Examiner*—Francis J. Bartuska

[57] ABSTRACT

The disclosed container for fluids has a pouring spout, the periphery of the container when empty and flat being defined essentially by straight side margins, and top and bottom margins that are curved inward and outward, respectively. A series of containers, formed of strip material, makes efficient use of the strip material by avoiding waste and by realizing a remarkably high ratio of container volume to area of wall material. The disclosed containers have a hang-up tab at the upper end of the container remote from the spout, the container being proportioned to avoid spilling of contents from the spout when the container is suspended by its hang-up tab.

8 Claims, 4 Drawing Figures

FIG. 1
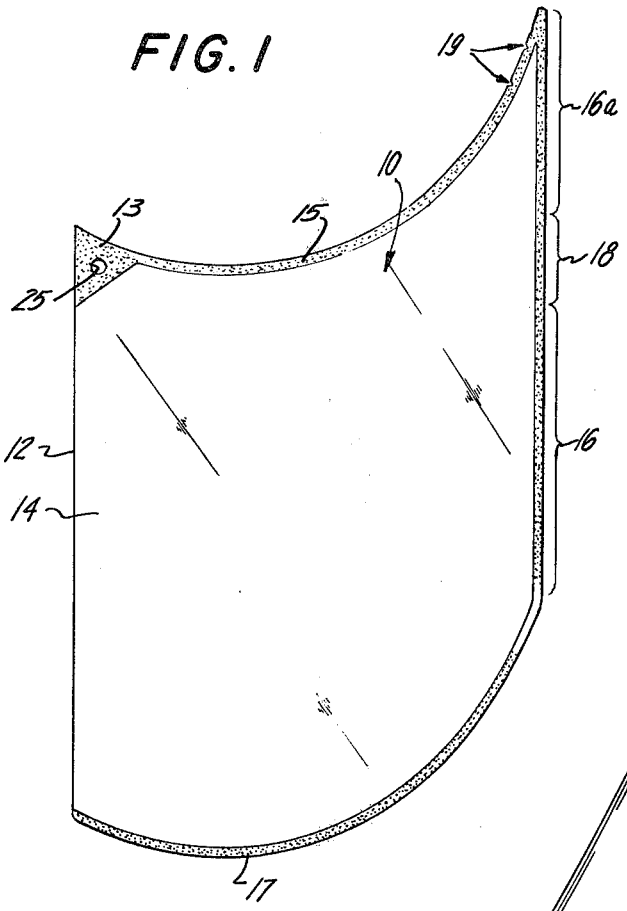
FIG. 4
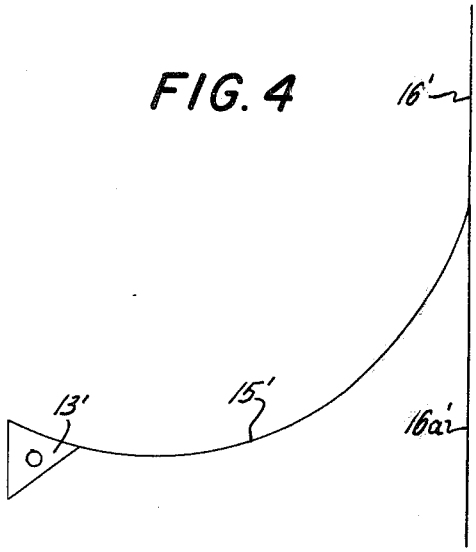
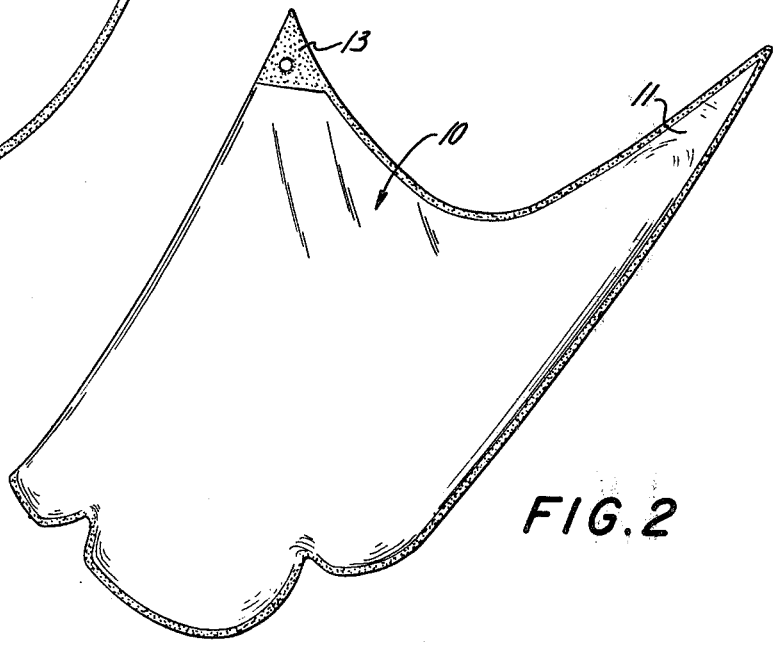
FIG. 2
FIG. 3
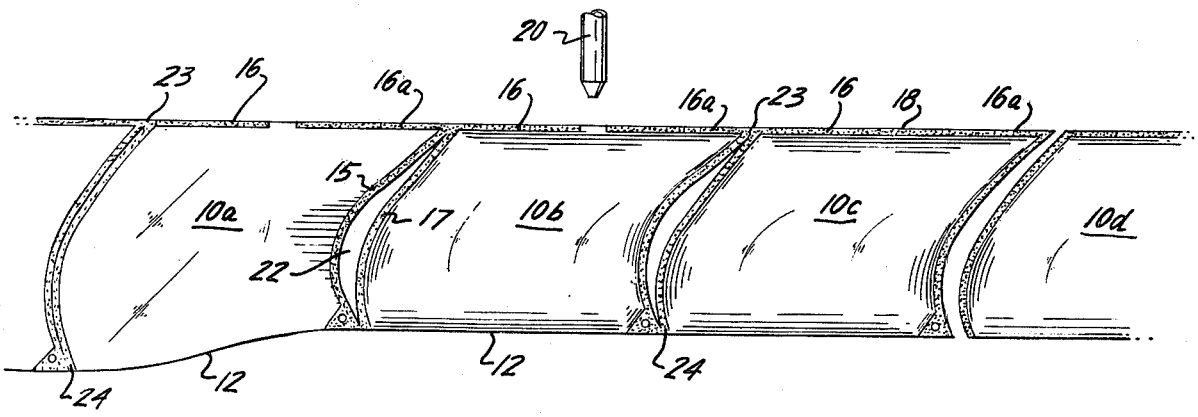

FLEXIBLE CONTAINER WITH POURING SPOUT

FIELD OF THE INVENTION

This invention relates to flexible-walled containers or pouches having spouts for dispensing contents, especially fluids. The spouts of the present containers may be self-sealing as in my U.S. Pat. Nos. 3,815,794 and 3,878,977.

BACKGROUND

Many forms of flexible-walled containers have been proposed, including those shown in my patents noted above, having spouts for dispensing fluids. The containers are commonly formed of thermoplastic strip material, either two opposed strips or a single strip folded lengthwise. Seams are formed to define the outline of the body portion of the container and the dispensing spout.

The walls of a container become distended when the container is filled. The material used in making the container is efficiently used (from one point of view) where the shape of the container results in a large ratio of volume of the filled container to the surface area of the container walls. A square container (for example) has a relatively small ratio of volume to surface area because the material forming the corners cannot become greatly distended to contribute to the container volume in contrast (for example) to the extreme expansion of the central areas of the container walls. However, eliminating corners would ordinarily be accomplished by rounding the corners and consequently leaving the material outside those corners as scrap. Such scrap obviously does not contribute to the volume of the container.

It is often required that a container is to have a spout that projects from the main body portion of the container. Separately it is known (see my U.S. Pat. No. 3,815,794) that high stress concentrations tend to develop where the outline of a container includes a corner whose apex is directed inward, toward the interior of the container. The problem of efficient utilization of strip material in making containers is complicated by the requirements that the container is to include a projecting spout and that inward-directed corners are to be avoided.

SUMMARY OF THE INVENTION

An object of the present invention resides in providing a flexible-wall container having a spout that projects from a main body portion of the container, of a form that lends itself to efficient utilization of strip material in making many such containers. A more specific but related object of the invention resides in provision of a pouch of this character, incorporating a hang-up tab.

A further object resides in the provision of a novel flexible-walled container having a projecting spout, produced efficiently of strip material, free of inwardly directed corners which would tend to develop high localized stresses.

A still further object resides in the provision of a strip of the novel containers that may be advanced through and filled in a filling machine.

The presently preferred illustrative embodiment of the invention considered in detail below meets the above objects and embodies a number of novel features and advantages. Strip thermoplastic material providing opposed but separate layers of material are integral with each other along a first margin which results either from a fold in the material or from a seam, and a second seam is made along a second straight margin of the strip opposite the first margin of the strip. End seams made across the strip material establish the bottom and top of the container. These end seams are curved and, ideally, they are alike so that there is no waste of material between successive containers along the strip. The curvature avoids high-stress inwardly directed corners, it eliminates inefficient utilization of wall material in what might otherwise be one or more outwardly directed corners, it is utilized in providing a projecting spout, and it can contribute to the self-sealing feature of the spout where desired.

The nature of the invention, including the foregoing and additional objects, novel features and advantages, will be more fully appreciated from the following detailed description of the illustrative embodiment of the invention in its various aspects and from the accompanying drawings.

BRIEF DESCRIPTION OF THE DRAWINGS

FIG. 1 is a front view of a flat, empty container.

FIG. 2 is a front view of a filled and suspended container.

FIG. 3 is a view of the successive stages of making a filled container.

FIG. 4 is an outline view of a heat-sealing and severing die blade unit useful in the process of FIG. 3.

DETAILED DESCRIPTION OF THE PREFERRED EMBODIMENTS

Referring now to FIG. 1, container 10 has a perimeter comprised of folded edge 12, top seal 15, first side seal portions 16 and **16*a*, bottom seal 17, and a further side seal portion 18**.

Considering the periphery of the container when flat (as shown), seal portions 16, **16*a* and 18 form a first side margin, bend 12 forms a second side margin, seam 17 along the bottom or lower end of the pouch forms a third margin that is arched outward of the body portion of the container, and seam 15 forms a third margin, being curved and arched inward from its ends toward the interior of the container. The end portion 16*a* of the first side seam and the right-hand end portion of the fourth or top margin 15** define a projecting spout and converge toward the tip of the spout.

Shaded region 13 is an area where the walls have been heat-sealed together and a hole 25 has been provided, forming a hang-up tab. This feature allows the containers or pouches to be readily displayed on retail store racks. Spout 11 is shaped suitably for dispensing the contents of the container. The spout has a gradual taper made possible by the configuration of curved margin 15 converging with seal **16*a*** toward the tip of the spout.

Heat seal region 17 is formed by the same seal and sever die unit element that forms heat seal 15. The outward curvature of the bottom of the container represents efficient utilization of the wall material in this region, imparting a high volume-to-surface ratio in contrast to (for example) a right-angled corner as in a square pouch. In addition, it enhances the aesthetic appeal of the overall shape of the container when filled, in minimizing formation of wrinkles and sharp protruding corners.

The width of the container (the distance between fold 12 and side seam 16, 16*a* and 18) should be less than the length of the container (the distance between the midpoints of heat seals 15 and 17). With this proportion, containers which are displayed by suspending them from hang-up tab 13 can come to rest with their discharge spouts 11 above the fluid level of the contents of the container, as shown in FIG. 2. If the container were wider than it is long, the tip of discharge spout 11 would tend to dip below the level of at least some of the contents. This may be important to some prospective purchasers who might want assurance that when the discharge spout is opened (by tearing across at starting nick 19), the container can be hung up by tab 13 with no danger of spillage of the contents. By making the width of the pouch less than its length, and making spout 11 project sufficiently further than tab 13 from the midpoint of the pouch, assurance is provided against escape of fluid from an open spout when the container is suspended by its tab 13. This midpoint of the pouch is a convenient reference. It may be defined as a point midway between margins 12 and 16, 16*a*, 18 and midway between the midpoints of seams 15 and 17.

With a pouch that is nearly as wide as it is long in its flat condition, the tip of the spout should be at least 10% of the length of the side margins higher that tab 13, viewing the side margins when they are vertical, for the tip of the spout to be higher than the hang-up tab of a suspended pouch. If the container is made sufficiently long and narrow, then it may be sufficient to offset the rectilinear side edges of the pouch only a little to form the projecting discharge spout 11. An extremely narrow pouch tends to hang much more nearly vertical because hang-up tab 13 is relatively closer to an axis of the container parallel to and midway between the side margins. On the other hand, if it is desired to have an extremely wide pouch in relation to its length, then the parallel side margins can be offset in the direction parallel to their length by a distance equal to at least 50% of the length of one of the edges, to cause an increase in the length of the discharge spout 11 sufficient to assure the tip of the spout coming to rest above the hang-up tab when the pouch is suspended by the tab.

It is by no means necessary for spout 11 to project above the level of hang-up tab 13 when the pouch is filled and suspended. Escape of liquid can be prevented by proper attention to the character of the seams forming the spout and the geometry of the spout. The spout can be made self-sealing, as more fully described in my U.S. Pat. No. 3,815,794. Such a seal can be released for dispensing fluid in various ways, as by squeezing the container.

Pouches 10 can be formed with efficient utilization of strip material, and a series of pouches can be formed as an interconnected series for filling as represented somewhat diagrammatically in FIG. 3. A single strip of thermoplastic film can be folded lengthwise along its centerline to form the side margin 12 of a series of pouches 10. The longitudinal edges of the strip are then aligned with each other. A combined sealing and severing die as shown in FIG. 4 can be used to produce empty pouches 10*a* (FIG. 3). The die can have the shape shown including die portions identified by primed numerals corresponding to the seams of the pouch in FIG. 1. Die portion 15′ is to sever the films and to form heat-seals uniting the opposed films being severed so as to produce seam 15 of one pouch and seam 17 of the adjoining pouch of the series along the strip of material. However, to special advantage, the severing action is limited so that the successive pouches remain interconnected at regions 23 and 24. Any of various suitable films may be used, such as polyethylene or laminated films, for example those having a heat-sealing layer as of polyethylene and one or more barrier layers as of nylon or saran or aluminum. The heated die can be used with a rubbery counter to sever the films where desired and to form heat-seams along the margins and at tab 13, as indicated above. Separate heated dies for forming seams and for the severing operation may be used in succession, in place of a combined seam-forming and severing die.

In FIG. 3, pouch 10*a* is empty, having been formed as described above. Pouch 10*b* is at a filling station, where filling nozzle 20 can enter the opening 10*a* between seam portions 16 and 16*a*. Pouch 10*b* is shown as having been filled. As such, its side margin 12 is closer to its side margin 16, 18*a*, 16*a* than in the case of empty pouch 10*a*. The filling operation tends to pull seam 17 of pouch 10*b* away from seam 15 of pouch 10*a*. Because these two seams 15 and 17 are parted except at their ends 23, 24, pouch 10*a* does not restrain the walls of pouch 10*b* from becoming distended as this pouch is being filled.

Pouch 10*c* represents the filled and sealed pouches. In a heat-sealing operation, seal portion 18 is formed to supplement seam portions 16 and 16*a*, thereby completing the side seam opposite fold 12.

The series of pouches is gripped along its upper margin during the feeding, filling and final sealing operations. As is well known, all these operations can be performed in one machine, or the strip of empty pouches can be preformed and then filled and sealed in another machine.

Connections 23 and 24 help in feeding a series of pouches to the filling station, and then they help in transporting the filled pouches to the sealing station and to a discharge point. The connections can then be parted (see pouch 10*d*) by pulling the filled and sealed pouches apart. However, the connections may be preserved since they can help in loading a strip of the filled and sealed pouches into cartons, and in subsequently dispensing filled pouches.

If the container is used for single-use dispensing, then the spout can be configured to avoid imparting a self-sealable function in the spout. For example, the parent strip of material can simply be reversed, so that the spout is formed along fold 12, and hang-up tab 13 is formed along the edge of seams 16, 16*a* and 18. Thus the pouch is filled on the side with the hang-up tab 13.

A pouch having spout and body portion shaped as shown in FIG. 1 is "self-sealing" (see U.S. Pat. No. 3,815,794) unless it leaks along a seam a condition that I call "channel leakage". A fold along one margin will ensure channel leakage. The channel-leakage condition can also result when the heat-sealing technique used in making the marginal seams of the spout is such as to develop a bulge of heat-softened material along the seam inside the spout. Such a bulge forces the walls of the spout to diverge for a short distance away from the seam, creating channel leakage.

Channel leakage is acceptable, even desirable, in the case of single-use pouches. Channel leakage is desirable where the pouch may be intended for dispensing drops. In that case a very small opening in the spout may be used, made by cutting across the seams very near the tip of the spout where the two seams meet at a small angle, or by tearing at the nick 19 close to the tip. On the other hand, where the seams are formed so as to avoid channel leakage and where only the tip of the illustrated spout is removed, a jet of fine droplets can be produced by squeezing the pouch.

It has been noted above that "inwardly directed corners" tend to develop high stresses in the wall of the pouch. That term relates to the perimeter of a pouch when flat. An inwardly-directed corner having a wide angle so as to approach 180° is not significant, but a right-angled corner can develop tear stresses in the wall tending to rupture the pouch. Rounding an inward-directed corner, at a radius of at least ¼ inch and preferably larger, tends to reduce sharply the stress in the wall when internal fluid pressure develops.

FIG. 2 shows a pouch having two puckers, which are to be distinguished from inward-directed corners in the periphery of an empty and flat pouch. Puckers do not cause the high stresses in the pouch wall that are caused by inward-directed corners.

Where a single strip of material is folded longitudinally on itself, or where two strips are face-to-face, in forming the walls of a series of pouches, the margins of those strips or of the single folded strip may be aligned as indicated above, or they may be deliberately misaligned, where seam portions 16, 16*a* are formed. Deliberately misaligned edges may facilitate entry of a filling nozzle into the opening that is later closed by seam portion 18.

Die portion 15' has been described as parting successive pouches from each other except at end portions 23 and 24. This parting can serve the intended purpose where the parting is incomplete, leaving the connection between successive pouches weak and readily rupturable.

The illustrative embodiment of the invention described in detail above and shown in the drawings involves several aspects some of which may be found useful without the others. Moreover, the described pouches are subject to a latitude of modification by those skilled in the art. Consequently, the invention should be construed broadly, in a manner consistent with its full spirit and scope.

What is claimed is:

1. A strip of containers for fluids connected integrally in series, each container including a pair of coextensive opposed walls of flexible material constituting a body portion and a tapered spout for dispensing fluids and each container of the series having peripheral margins along which the walls are fixed to each other, said margins including first and second parallel rectilinear side margins at least approximately equal in length extending along the strip, a third margin along the bottom of the container, and a fourth margin along the top of the container, said third margin being curved outward in relation to the middle of said body portion when the container is flat and said fourth margin being curved inward toward the middle of said body portion of the container, portions of said first and fourth margins of each container converging toward respective ends to define said tapered spout, said first and second side margins of each container being substantially offset in relation to each other so that the upper end of the first side margin at the tip of the spout projects substantially upward beyond the upper end of the second side margin, each said container being adapted to be flat when the container is empty, the third and fourth margins of each container being curved at least approximately alike and crossing said strip, respective third and fourth margins of successive containers being adjacent one another and unitary at least along part of the lengths thereof so as to interconnect the containers of the strip, thereby producing containers having a relatively high ratio of container volume to wall surface without significant waste of material.

2. A strip of containers as in claim 1, wherein said walls of each container comprise a hang-up tab at a region defined in part by end portions of said second and fourth margins remote from said spout.

3. A strip of containers as in claim 1 wherein the offset of said first and second side margins of each container is at least 10% of the length of the first margin.

4. A strip of containers as in claim 2 wherein the lengths of said side margins are related to the width of each container so that liquid in the container does not spill from the spout when its tip is open and when the container is suspended by said hang-up tab.

5. A container as in claim 1, wherein the margins of each container are individually and collectively free of inwardly directed corners that would create stress concentrations in the walls when the container is full.

6. A strip of containers as in claim 1, wherein said flexible material is a heat-sealable thermoplastic film and wherein said walls of each container are fixed to each other by a heat seal along said one margin, said heat seal having a discontinuity affording a filling port.

7. The combination of containers in strip form as in claim 4, wherein the offset of said first and second side margins of each container is at least 10% of the length of the first margin.

8. A series of containers as in claim 1 wherein adjacent top and bottom curved margins of successive containers of the strip are partially parted from each other.

* * * * *